United States Patent [19]

Chantland

[11] 4,037,356

[45] July 26, 1977

[54] SPINNING HOOP

[76] Inventor: Gilbert S. Chantland, R.R. No. 1, Tama, Iowa 52339

[21] Appl. No.: 613,468

[22] Filed: Sept. 15, 1975

[51] Int. Cl.[2] ..... A63H 1/32

[52] U.S. Cl. ..... 46/47; 46/51

[58] Field of Search ..... 46/47, 51

[56] References Cited

U.S. PATENT DOCUMENTS

| | | | |
|---|---|---|---|
| 2,928,206 | 3/1960 | Kuhn | 46/51 |
| 3,140,871 | 7/1964 | Liquori | 46/51 |
| 3,260,014 | 7/1966 | Krueger | 46/47 |

*Primary Examiner*—Louis G. Mancene
*Assistant Examiner*—Robert F. Cutting
*Attorney, Agent, or Firm*—Zarley, McKee, Thomte & Voorhees

[57] ABSTRACT

A spinning hoop comprised of a circular hollow tube with an elongated ballast element or wire therein. A ring element is rotatably secured to the hoop at a point along its circumference and a swivel element is secured to the ring. A manually operable cord element is secured to this swivel element to effect the spinning of the hoop device.

3 Claims, 5 Drawing Figures

SPINNING HOOP

BACKGROUND OF THE INVENTION

The spinning of a western-type lariat rope and the many tricks that can be accomplished with such a device are well-known. However, these feats are not easily accomplished and can be done only after much practice and training.

An object of this invention is to provide a spinning hoop wherein many of the feats accomplished with a lariat can be practiced without substantial training or experience. A further object of this invention is to provide a spinning hoop which can be successfully utilized by youngsters and which is lightweight and economical to manufacture.

These and other objects will be apparent to those skilled in the art.

BRIEF DESCRIPTION OF THE DRAWINGS

This invention consists in the construction, arrangements and combination of the various parts of the device, whereby the objects contemplated are attained as hereinafter more fully set forth, specifically pointed out in the claims, and illustrated in the accompanying drawings, in which:

DESCRIPTION OF THE PREFERRED EMBODIMENT

Figure 3:
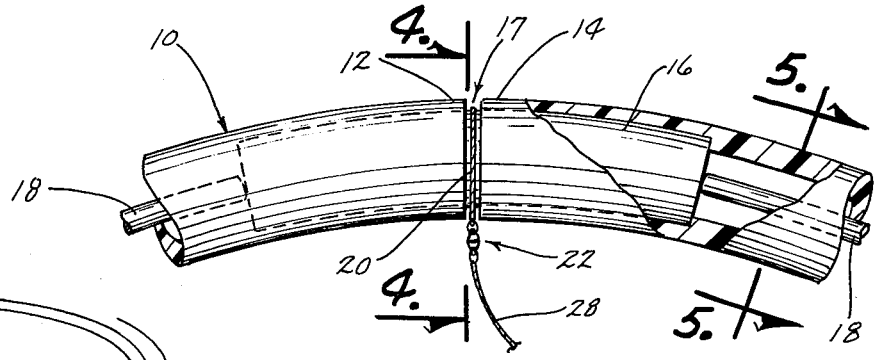
FIG. 3 is a partial sectional view thereof on an enlarged scale taken on line 3 — 3 of FIG. 2.
Figure 2:
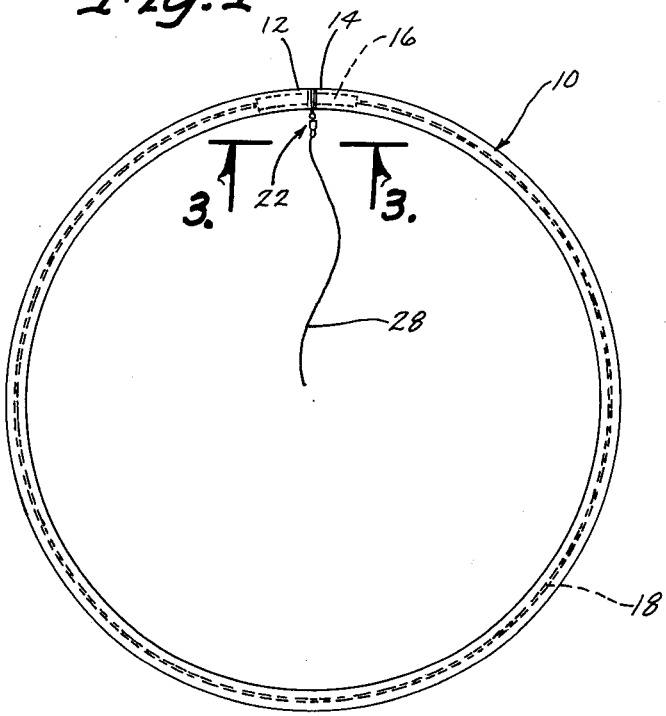
FIG. 2 is a top plan view thereof at an enlarged scale.
Figure 4:
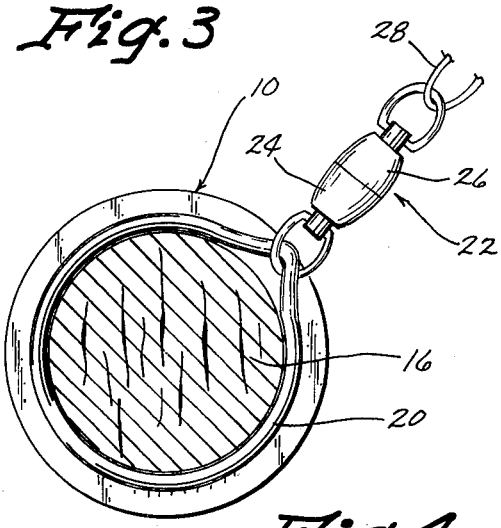
FIG. 4 is a cross sectional view taken on line 4 — 4 of FIG. 3.
Figure 5:
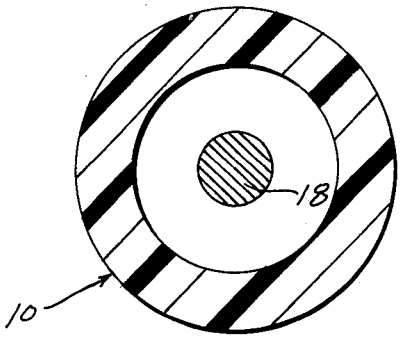
FIG. 5 is a further cross sectional view taken on line 5 — 5 of FIG. 3.

The hoop 10 is comprised of an elongated hollow tube with opposite ends 12 and 14. A dowel 16 is inserted into the hollow ends 12 and 14 and a suitable glue (not shown) or other fastening means secures the ends of the hoop to the dowel. As shown in FIG. 3 the opposite ends of the hoop 12 and 14 are closely spaced with respect to each other to create a groove 17 around the center portion of the dowel.

A ballast element 18 preferably comprised of an elongated wire or rod is located within the hollow center portion of the hoop 10.

A ring 20 is rotatably mounted in groove 17 around the center portion of dowel 16. The ring is permitted to rotate around the dowel but is held against longitudinal movement on the dowel by the abutting ends 12 and 14 of the hoop 10.

A swivel means 22 is connected to ring 20. Swivel means 22 is of conventional construction and is comprised of swivel elements 24 and 26 which are rotatably secured to each other. A cord 28 is secured to swivel element 26. The function of the swivel means 22 is to permit spinning and other movement of the hoop 10 without necessarily imparting a twisting motion to the cord 28.

In operation, the operator grasps the outer free end of cord 28 and manipulates the hoop 10 in any desired manner. With a proper gyrating hand motion, the hoop

Figure 1:
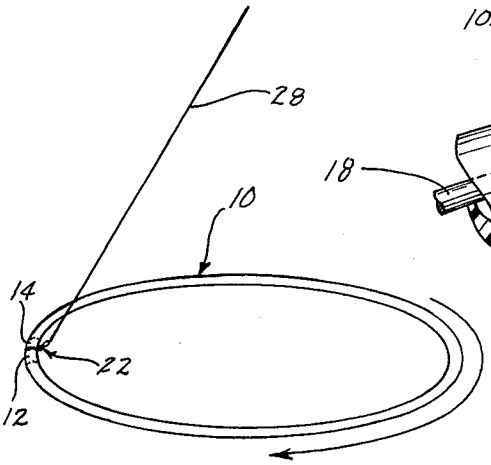
FIG. 1 is a perspective view of the spinning hoop of this invention.
Figure 6:
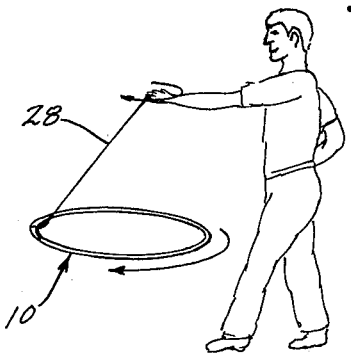
FIG. 6, is a perspective view showing the device in operation.

10 will spin in a horizontal plane as shown in FIGS. 1 and 6. The hoop 10 can also rotate in a vertical plane and is capable of spinning, rotating and moving in a plurality of ways depending upon the imagination and the ability of the operator.

The rotation of the ring 20 with respect to the dowel, in combination with the conventional function of the swivel 22 permits a plurality of attitudes between the cord 28 and the hoop to be achieved without imposing any stress on any of the component parts. The ballast element 18 adds weight to the otherwise lightweight hoop 10 which is normally of plastic material or the like and serves to give a "flywheel" effect to the spinning hoop.

The diameter of the hoop 10 is normally in the order of 20 inches, but the principle of the invention is applicable to hoops of different dimensions.

From the foregoing, it is seen that the device of this invention will accomplish at least all of its stated objectives.

I claim:

1. A spinning hoop, comprising,
a circular hoop element,
a swivel means secured to said hoop element at a point along the circumference thereof, and
a supporting cord for hand manipulation secured to said swivel means so that said hoop may be spun and moved relative to said cord without imparting substantial twisting of said cord,
said hoop being a hollow tube,
and an elongated metal ballast element extending through a substantial portion of the length of the interior of said hollow tube.

2. A spinning hoop, comprising,
a circular hoop element,
a swivel means secured to said hoop element at a point along the circumference thereof, and
a supporting cord for hand manipulation secured to said swivel means so that said hoop may be spun and moved relative to said cord without imparting substantial twisting of said cord,
said hoop element being comprised of a length of hollow tube having opposite ends, a dowel mounted in said ends, said dowel having an outside diameter less than the outside diameter of said tube, means holding the ends of said tube to said dowel to form said hoop element into a circular configuration, said opposite ends of said tube being spaced to expose said dowel, and said swivel means rotatably secured to said dowel between said ends of said hoop element to permit said swivel means to rotate about the cross-sectional diameter of said tube,
and an elongated metal ballast element extending through a substantial portion of the length of the interior of said hollow tube.

3. A spinning hoop, comprising,
a circular hoop element,
a swivel means secured to said hoop element at a point along the circumference thereof, and
a supporting cord for hand manipulation secured to said swivel means so that said hoop may be spun and moved relative to said cord without imparting substantial twisting of said cord,
said hoop element being comprised of a length of hollow tube having opposite ends, a dowel mounted in said ends, said dowel having an outside diameter less than the outside diameter of said tube, means holding the ends of said tube to said dowel to form said hoop element into a circular configuration, said opposite ends of said tube being spaced to expose the entire circumference of said dowel, a ring rotatably embracing said dowel between the ends of said tube, said swivel means being rotatably secured to said ring to permit said swivel means to rotate about the cross-sectional diameter of said tube, and an elongated medal ballast element extending through a substantial portion of the length of the enterior of the hollow tube.

* * * * *